US006237740B1

(12) United States Patent
Weatherall et al.

(10) Patent No.: US 6,237,740 B1
(45) Date of Patent: May 29, 2001

(54) COMPOSITE HANDRAIL CONSTRUCTION

(75) Inventors: Douglas J. Weatherall, Whitby (CA); Andrew O. Kenny, North York (CA); Ronald H. Ball, 1083 Beaufort Avenue, Oshawa, Ontario (CA), L1G 1G8; Stuart A. Caunce, Scarborough (CA)

(73) Assignee: Ronald H. Ball, Lindsay, Ontario (CA)

( * ) Notice: Subject to any disclaimer, the term of this patent is extended or adjusted under 35 U.S.C. 154(b) by 0 days.

(21) Appl. No.: 09/106,470

(22) Filed: Jun. 30, 1998

(51) Int. Cl.[7] ..... B66B 23/24
(52) U.S. Cl. ..... 198/337
(58) Field of Search ..... 198/335, 337

(56) References Cited

U.S. PATENT DOCUMENTS

| | | |
|---|---|---|
| Re. 27,439 | 7/1972 | Jackson et al. . |
| 1,049,613 | 1/1913 | Seeberger . |
| 1,101,209 | 6/1914 | Pitt . |
| 1,186,550 | 6/1916 | Cobb . |
| 2,373,764 | 4/1945 | Lautrup et al. . |
| 2,669,339 | 2/1954 | Hansen . |
| 2,721,158 | 10/1955 | Mans . |
| 2,879,881 | 3/1959 | Tilton . |
| 2,956,662 | 10/1960 | Hansen . |
| 2,979,431 | 4/1961 | Perrault . |
| 3,048,256 | 8/1962 | Skinner . |
| 3,212,627 | 10/1965 | Beebee . |
| 3,411,980 | 11/1968 | Leshin . |
| 3,414,109 | 12/1968 | Clark . |
| 3,463,290 | 8/1969 | Tajima . |
| 3,481,807 | 12/1969 | Kanamori . |
| 3,623,590 | 11/1971 | Johnson . |
| 3,633,725 | 1/1972 | Smith . |
| 3,689,341 | 9/1972 | Ninomiya . |
| 3,693,218 | 9/1972 | Jaubert et al. . |
| 3,724,645 | 4/1973 | Spaar . |
| 3,778,882 | 12/1973 | Cameron et al. . |

(List continued on next page.)

FOREIGN PATENT DOCUMENTS

| | | |
|---|---|---|
| 898726 | 4/1972 | (CA) . |
| 936569 | 11/1973 | (CA) . |
| 1048301 | 2/1979 | (CA) . |
| 1261583 | 9/1989 | (CA) . |
| 2247737 | 3/1999 | (CA) . |
| 839624 | 5/1952 | (DE) . |
| 860477 | 12/1952 | (DE) . |
| 907996 | 4/1954 | (DE) . |
| 1027539 | 4/1958 | (DE) . |
| 1127279 | 4/1962 | (DE) . |
| 1019958 | 12/1964 | (DE) . |
| 1936192 | 6/1971 | (DE) . |
| 2 000 266 | 7/1971 | (DE) . |
| 21 42 098 | 3/1973 | (DE) . |
| 29 11 753 | 10/1980 | (DE) . |
| 29 16 253 | 10/1980 | (DE) . |
| 31 06 253 | 9/1982 | (DE) . |
| 31 13 810 | 10/1982 | (DE) . |
| 32 08 916 | 9/1983 | (DE) . |
| 34 33 914 | 3/1986 | (DE) . |
| 37 04 524 | 2/1989 | (DE) . |
| 39 21 887 | 1/1991 | (DE) . |
| 39 21 888 | 1/1991 | (DE) . |
| 39 30 351 | 3/1991 | (DE) . |

(List continued on next page.)

*Primary Examiner*—Christopher P. Ellis
*Assistant Examiner*—Mark A. Deuble
(74) *Attorney, Agent, or Firm*—Bereskin & Parr

(57) ABSTRACT

A moving handrail construction, for escalators, moving walkways and other transportation apparatus has a handrail having a generally C-shaped cross-section and defining an internal generally T-shaped slot. The handrail is formed by extrusion and comprises a first layer of thermoplastic material extending around the T-shaped slot. A second layer of thermoplastic material extends around the outside of the first layer and defines the exterior profile of the handrail. A slider layer lines the T-shaped slot and is bonded to the first layer. A stretch inhibitor extends within the first layer. The first layer is formed from a harder thermoplastic than the second layer, and this has been found to give improved properties to the lip and improved drive characteristics on linear drives.

17 Claims, 8 Drawing Sheets

U.S. PATENT DOCUMENTS

| | | | | |
|---|---|---|---|---|
| 3,783,063 | | 1/1974 | Olsson . | |
| 3,783,704 | | 1/1974 | Lawson . | |
| 3,865,225 | | 2/1975 | Phal . | |
| 3,872,735 | | 3/1975 | Hnatek . | |
| 3,874,968 | | 4/1975 | Robinson . | |
| 3,885,071 | | 5/1975 | Blad et al. . | |
| 3,949,858 | | 4/1976 | Ballocci et al. . | |
| 3,956,056 | | 5/1976 | Boguslawski et al. . | |
| 3,981,206 | | 9/1976 | Miranti, Jr. et al. . | |
| 4,032,384 | | 6/1977 | Rauscher . | |
| 4,034,617 | | 7/1977 | Guyer . | |
| 4,050,322 | | 9/1977 | Moring . | |
| 4,087,223 | | 5/1978 | Angioletti et al. . | |
| 4,161,769 | | 7/1979 | Elliott . | |
| 4,169,393 | | 10/1979 | Wetzel et al. . | |
| 4,274,821 | | 6/1981 | Kiemer . | |
| 4,359,501 | | 11/1982 | Ditullio . | |
| 4,381,273 | | 4/1983 | Azzola . | |
| 4,427,107 | | 1/1984 | Roberts et al. . | |
| 4,439,387 | | 3/1984 | Hawley . | |
| 4,469,729 | | 9/1984 | Watanabe et al. . | |
| 4,548,663 | | 10/1985 | Worcester . | |
| 4,563,140 | | 1/1986 | Turecek . | |
| 4,564,542 | | 1/1986 | Worcester . | |
| 4,578,024 | | 3/1986 | Sicka et al. . | |
| 4,600,549 | | 7/1986 | Rajala et al. . | |
| 4,618,387 | | 10/1986 | Fisher et al. . | |
| 4,650,446 | | 3/1987 | Pinto et al. . | |
| 4,681,646 | | 7/1987 | Pinto et al. . | |
| 4,767,244 | | 8/1988 | Peterson . | |
| 4,776,446 | | 10/1988 | Fisher et al. . | |
| 4,839,220 | | 6/1989 | Stijntjes et al. . | |
| 4,852,713 | | 8/1989 | Tatai et al. . | |
| 4,891,040 | | 1/1990 | Nagai et al. . | |
| 4,934,100 | | 6/1990 | Adell . | |
| 4,946,020 | | 8/1990 | Rivera et al. . | |
| 4,948,354 | | 8/1990 | Minaudo . | |
| 4,957,199 | | 9/1990 | Wokke et al. . | |
| 5,020,256 | | 6/1991 | French . | |
| 5,083,985 | | 1/1992 | Alles . | |
| 5,115,900 | | 5/1992 | Nurnberg et al. . | |
| 5,160,009 | | 11/1992 | Iyoda et al. . | |
| 5,162,151 | | 11/1992 | Smith et al. . | |
| 5,165,643 | | 11/1992 | Shreiner . | |
| 5,255,772 | * | 10/1993 | Ball et al. | 198/337 |

FOREIGN PATENT DOCUMENTS

| | | | | |
|---|---|---|---|---|
| 4 118 946 | | 5/1992 | (DE) . | |
| 0 134 545 | | 3/1985 | (EP) . | |
| 0 185 006 | | 6/1986 | (EP) . | |
| 0 273 479 | | 6/1988 | (EP) . | |
| 2006690 | * | 1/1970 | (FR) | 198/337 |
| 2161856 | | 7/1973 | (FR) . | |
| 2442935 | | 6/1980 | (FR) . | |
| 1 355 039 | | 5/1974 | (GB) . | |
| 2243163 | | 10/1991 | (GB) . | |
| 2327405 | | 1/1999 | (GB) . | |
| 52-31481 | * | 3/1977 | (JP) | 198/337 |
| 52-16629 | | 5/1977 | (JP) . | |
| 58-171594 | | 10/1983 | (JP) . | |
| 58-222833 | | 12/1983 | (JP) . | |
| 59-85728 | | 5/1984 | (JP) . | |
| 62-189147 | | 8/1987 | (JP) . | |
| 2-277848 | | 11/1990 | (JP) . | |
| 4-106092 | | 4/1992 | (JP) . | |
| 4-185788 | | 7/1992 | (JP) . | |
| 4-194011 | | 7/1992 | (JP) . | |
| 7-206351 | | 8/1995 | (JP) . | |

* cited by examiner

COMPOSITE HANDRAIL CONSTRUCTION

FIELD OF THE INVENTION

This invention relates to moving handrails for escalators, moving walkways and similar transportation apparatus. This invention is more particularly concerned with such handrails that are formed by extrusion.

BACKGROUND OF THE INVENTION

Moving handrails have been developed for escalators, moving walkways and other similar transportation apparatus. The basic profile for such handrails has now become fairly standardized, even though the exact dimensions may vary from manufacturer to manufacturer. Similarly, all conventional handrails have certain key or essential components.

In this specification, including the claims, the structure of a handrail is described, as oriented on the upper run of a handrail balustrade, in a normal operational position. It will be appreciated that a handrail is formed as a continuous loop. Of necessity, any part of the handrail will travel around the entire loop, and during passage around the loop will rotate through 360° about a transverse axis. The structure of both the handrail of the present invention, and conventional structures are all described relative to a vertical section taken through a top, horizontally extending run of the handrail.

A conventional handrail has a main, top portion, forming a main body of the handrail. Extending down from this top portion are two C-shaped or semi-circular lips. The main body and the lips define a T-shaped slot which opens downwardly and which has a width much greater than its height. The thickness of the handrail through the main body and the lips is usually fairly uniform.

As to the main or common components of a handrail, the body and lips are usually formed from a thermoset material. Some form of stretch inhibitor is provided along a neutral axis in the top portion, generally spaced just above the T-shaped slot. This stretch inhibitor is commonly steel tape, steel wire, glass strands or Kevlar cords.

To ensure that the handrail glides easily along guides, a lining is provided, around the outside of the T-shaped slot. This lining is sometimes referred to as a slider, and commonly is a synthetic or natural fiber based textile based fabric. It is selected to provide a low coefficient of friction relative to steel or other guides. The outside of the main body and the lips are covered with a cover stock, which is a suitable thermoset material.

Within the basic handrail profile, there can be selected plies, as detailed below, to provide desired characteristics to the handrail.

Now, a handrail has to meet a number of different requirements, many of which can conflict with each other. In conventional handrails, these are often addressed by introducing a number of different elements, in addition to or as variations of those outlined above. This is quite feasible in a conventional handrail structure, which is formed from a thermoset material. Conventionally, handrails are made stepwise or incrementally in lengths of approximately 3 m at a time, corresponding to the length of the vulcanising press. Thus, all the various elements required for a handrail, e.g. layers of fabric, layers of fresh, uncured thermoset material, tensile reinforcing elements are brought together. If fabric plies are incorporated, these are provided coated in uncured rubber. Thus, all the layers present uncured, tacky rubber surfaces, and these are pressed together either manually with rollers or by assembly equipment. The necessary length of these assembled elements is placed into a mold. There, the necessary temperature and pressure are applied, to vulcanize the thermoset material, and ensure that the elements together adopt the desired profile defined by the mold cavity. Once cured, the mold is opened, and the cured section moved out of the mold, to bring in the next length of already assembled elements for molding.

This technique has a number of disadvantages. It is slow, it produces the handrail in only incremental lengths, and it can result in a poor finish with mold markings. It does, however, have the advantage that relatively complex structures can be assembled, with numerous different elements, designed to give different characteristics.

The inventors of the present invention have developed a technique for extruding handrails from a thermoplastic material. This has the great advantage that the handrail can be produced essentially continuously and at a greater speed. The handrail can have a consistently high and uniform external appearance, which is highly desirable in a product that is one of the most visible elements of an escalator or handrail installation and which is gripped by users.

However, extruding the relatively complex structure of a handrail is not simple. Others have made proposals for extruding handrails, but to the inventors' knowledge none of these have been successful; this is believed to be because of the difficulty in reliably and consistently bringing the various elements together. In particular, techniques from the known art of batch or piecewise molding of handrails from thermoset material cannot simply be incorporated into an extruded handrail. Rather, techniques from such batchwise molding are inapplicable to a continuous, extruded molding technique.

More particularly, older techniques which simply teach introducing additional layers to give desired strength and other characteristics are simply inapplicable to an extruded handrail. For conventional molding operations where the various layers are pre-assembled, it is usually a relatively simple matter to introduce one or more additional layers. This may require a certain element of care and skill in assembling the handrail and it may increase the cost, but it is possible and it does not fundamentally alter the various steps in the molding operation.

In contrast, considered as a thermoplastic extrusion operation, extrusion of a basic handrail structure is already a complex operation involving a number of separate elements, with care having to be taken to ensure that they each are in the correct location in the finished profile; for example, the tensile elements must remain in the correct plane, while the slider fabric must be shaped to the relatively complex profile of the slot of the handrail. To introduce additional layers or plies is thus extremely difficult, and costly as it requires extra plies to be prepared by slitting and possibly coating with adhesive.

Considering now the characteristics that a handrail must meet, these essentially relate to its ability to remain on handrail guides and to be driven. Thus, the lips of the handrail must have sufficient strength to prevent derailment or detachment from the handrail guides. This is usually determined by measuring the load or force for a given lateral deflection of the lips. The spacing between the lips of the lip dimension must also be correct and be constant or maintained, within specific tolerances, throughout the handrail life. To introduce additional strengthening layers or plies is extremely difficult.

As to drive characteristics, there must be adequate friction between the handrail and a drive unit and the handrail must not be damaged by loads applied by a drive unit. One technique is to pass the handrail around a relatively large diameter pulley which engages the inner surface of the handrail, and often causes the handrail to be bent backwards to increase the contact with a drive wheel. While this could give adequate drive characteristics, it had a number of disadvantages. Such a drive requires a relatively large space, and passing the handrail through a reverse bend can cause undesirable stresses resulting in shortening of the handrail life.

Another technique is the use of so-called linear drives, which are the preferred system in some parts of the world. In a linear drive, the handrail is simply passed through one or more pairs of rollers, which are pressed against the handrail. For each pair of rollers, one of the rollers simply acts as a follower wheel or pulley, while the other is driven and acts to drive the handrail. To ensure adequate transmission of the drive force, the pairs of pulleys or wheels are pressed together with very high forces. This can impose very high internal stresses on the handrail causing a number of problems. The shear stresses generated in the nip between the pair of wheels can cause delamination of the plies in a conventional rubber, thermoset product. For tensile elements formed from stranded, twisted steel wire, glass yarns and the like, the stresses can cause a grinding action, resulting in fretting fatigue.

However, linear drive characteristics are desirable for a number of reasons. They eliminate the reverse bend problem of other drive units. They are more compact, and hence desirable, for example in escalator installations which have a transparent balustrade, limiting the space available for the handrail drive and reducing the length of handrail required. Also, for different sized installations, it is simply a matter of increasing the number of drive rollers to match the size of the installation.

A number of techniques have been proposed in the art for providing a conventionally molded handrail with the desired characteristics. However, many of these are relatively complex, and are only generally applicable to conventional piecewise molding techniques for thermoset materials. Thus, U.S. Pat. No. 5,255,772 is directed to a handrail for escalators and moving walkways with improved dimensional stability. This is essentially achieved by providing a sandwich structure in which two layers of plies are provided on either side of a layer of rubber composition in which the steel wires or other tensile members are embedded. This is preferably a higher strength rubber, so that a structural sandwich composition is formed with the two layers of plies.

Importantly, the two opposing layers of plies in this structure have their stiff principal yarns extending perpendicularly to the stretch inhibitor and hence perpendicular to the steel cables of the stretch inhibitor. The intention here is to improve the bending strength of the lips in response to lateral forces tending to deform the lips outwards.

However, such a structure is complex and has numerous different layers. It would be exceedingly difficult to form such a structure by extrusion. In addition to the basic elements listed above, it would, somehow, require the introduction of two additional plies of fabric material, which would have to be located at exact configurations within the extruded handrail.

Alternative approaches, allegedly suitable for extruded handrails, are found in U.S. Pat. Nos. 3,633,725 and 4,776,446. In the first of these patents, there is proposed a somewhat unusual structure in which an internal portion of the handrail is provided with a toothed structure to facilitate driving and also to facilitate bending. Then, a separate cover is provided. U.S. Pat. No. 4,776,446 provides so-called wear strips on the insides of each of the lips. These are intended to provide two functions, namely to provide a low co-efficient of sliding and improve the lip strength. These are constructed from a stiff, plastic material, e.g. nylon. It is suggested that they be co-extruded with the handrail, although no extrusion technique is disclosed. To permit these wear strips to flex, they are continuous on one side and provided with slots separating the other side into a row of leg portions. However, this simply forms stress concentrations and these relatively ridged wear strips would suffer cracking and flex fatigue, in use, due to repeated bending.

SUMMARY OF THE INVENTION

Accordingly, it is desirable to provide a handrail which would lend itself to continuous production by extrusion, and which would have good or enhanced lip strength, good lip dimensional stability, provide resistance to fretting fatigue and delamination, and have characteristics enabling maximum drive force transmission on a linear drive.

In accordance with the present invention, there is provided a moving handrail construction, the handrail having a generally C-shaped cross-section and defining an internal generally T-shaped slot, the handrail being formed by extrusion and comprising:

(1) a first layer of thermoplastic material extending around the T-shaped slot;

(2) a second layer of thermoplastic material extending around the outside of the first layer and defining the exterior profile of the handrail;

(3) a slider layer defining the T-shaped slot and bonded to the first layer; and (4) a stretch inhibitor extending within the first layer, wherein the first layer is formed from a harder thermoplastic than the second layer.

Preferably, the handrail comprises an upper web above the T-shaped slot and two lip portions extending downwardly from the upper web around the T-shaped slot, wherein within the upper web at least, the first layer is thicker than the second layer. Unlike known proposals, the first layer can extend from the slider layer to the second layer, without any intervening plies. The upper web can have a thickness of approximately 10 mm and the first layer is then preferably at least 6 mm thick. It is believed that it is this substantial first layer, when formed of a relatively hard thermoplastic, that gives the handrail improved drive characteristics in a linear drive, as detailed below.

Advantageously, the first layer has a hardness in the range 40–50 Shore 'D' and the second layer has a hardness in the range 70–85 Shore 'A'.

In accordance with another aspect of the present invention, there is provided a moving handrail construction, the handrail having a generally C-shaped cross-section and defining an internal, generally T-shaped slot, the handrail being formed by extrusion and comprising:

(1) a first layer of thermoplastic material extending around the T-shaped slot;

(2) a second layer of thermoplastic material extending around the outside of the first layer and defining the exterior profile of the handrail;

(3) a slider layer lining the T-shaped slot and bonded to first layer at least; and (4) a stretch inhibitor extending within the first layer, wherein the first layer is formed from a harder thermoplastic than the second layer, and wherein there is a direct interface between the first and second layers, with the first and second layers bonded to one another to form a continuous thermoplastic body, without any intervening layer of material between the first and second layers.

A further aspect of the present invention provides a moving handrail construction comprising the handrail having a generally C-shaped cross-section and defining an internal, generally T-shaped slot, the handrail being formed by extrusion and comprising:

(1) a first layer of thermoplastic material comprising an upper portion and tapered edged portions extending only partially around the T-shaped slot;

(2) a second layer of thermoplastic material comprising an upper portion abutting the first layer of thermoplastic material and semi-circular edge portions extending around the T-shaped slot, the second layer of thermoplastic material defining the exterior profile of the handrail;

(3) a slider layer lining the T-shaped slot and bonded to the first and second layers; and (4) a stretch inhibitor extending within the first layer, wherein the first layer is formed from a harder thermoplastic than the second layer.

The handrail can have a simple structure suitable for extrusion with no additional layers of fabric, so that there is a direct interface between the two layers of thermoplastic which are bonded directly to one another. If they are made of the same material, e.g. TPU, and coextruded, it has the additional advantage of a bond equal to the tear strength of the two materials. There is not risk of delamination as with a plied product.

BRIEF DESCRIPTION OF THE DRAWINGS

For a better understanding of the present invention and to show more clearly how it may be carried into effect, reference will now be made, by way of example, to the accompanying drawings in which.

DESCRIPTION OF THE PREFERRED EMBODIMENTS

Figure 1:
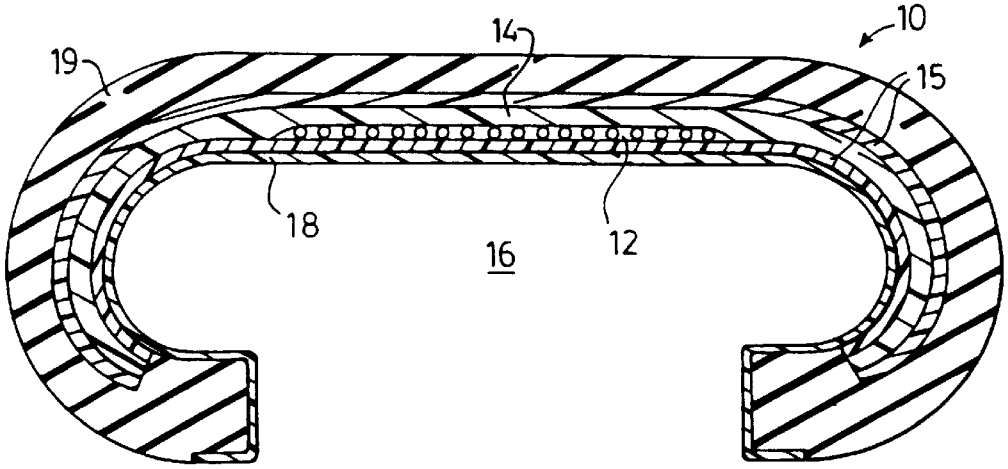
FIG.1 Prior Art
FIG. 1 is a cross-sectional view through a conventional handrail.

Reference will first be made to FIG. 1, which shows a cross-section through a conventional handrail. As noted above, FIG. 1 as also for FIG. 2, shows a handrail as it would be extending along the top, horizontal run of a handrail installation.

The conventional handrail is generally designated by the reference 10. In known manner, the handrail 10 includes a stretch inhibitor 12, which can comprise steel cables, steel tape, Kevlar or other suitable tensile elements. As shown, this is supplied embedded in a layer of rubber. The stretch inhibitor 12, and its rubber coating, and a layer 14 of relatively hard rubber are embedded between two fabric plies 15. The fabric plies 15 and hard rubber 14 can comprise a structure as defined in U.S. Pat. No. 5,255,772.

The fabric plies 15 extend partially around a T-shaped slot 16, around which is located a slider fabric 18. The ends of the slider or slider fabric 18 extend out of the slot 16, as shown. To complete the handrail, an outer coverstock 19 is molded around the outside of the fabric plies 15, again as in U.S. Pat. No. 5,255,772.

Reference will now be made to FIG. 2, which shows a handrail construction in accordance with the present invention, and generally designated by the reference 20.

The handrail 20 includes tensile elements or a stretch inhibitor 22, which here comprise a number of steel wires which, typically, can have a diameter in the range 0.5 to 2 mm. Any suitable stretch inhibitor can be provided. A T-shaped slot 24 is lined by a slider fabric 26. The slider fabric is an appropriate cotton or synthetic material, with a suitable texture that a drive wheel of a linear drive apparatus can bite into and engage, as detailed below.

Now, in accordance with the present invention, the body of the handrail comprises an inner layer 28 of a relatively hard thermoplastic and an outer layer 30 of a relatively soft thermoplastic. The steel wires or tensile elements 22 are embedded in the inner layer 28 and adhered thereto with a suitable adhesive. The layers 28, 30 bond directly to one another at an interface to form a continuous thermoplastic body.

Figure 2A:
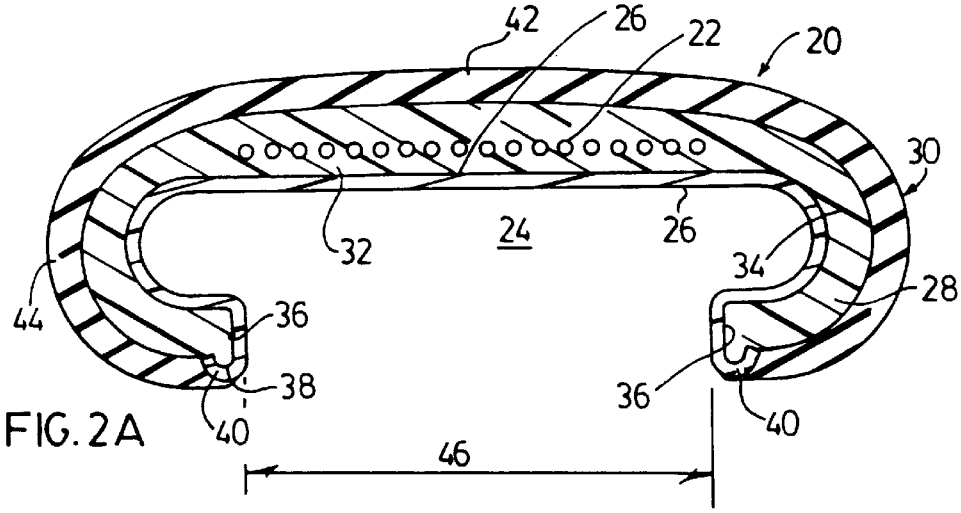
FIG. 2*a* is a cross-sectional view through a handrail in accordance with a first embodiment of the present invention.

As shown in the first embodiment of FIG. 2*a*, the inner layer 28 comprises an upper portion or web 32 of generally uniform thickness, which continues into two semi-circular lip portions 34. The lip portions 34 terminate in vertical end surfaces 36 and small downward facing ribs 38 are provided adjacent the ribs. The slider fabric 26 then includes end portions 40 wrapped around these downwardly facing ribs 38.

The outer layer 30 correspondingly has an upper portion 42 and semi-circular portions 44, with a larger radius than the semi-circular lip portions 34. As shown, the semi-circular lip portions 44 slightly overlap the edge portions 40 of the slider.

Now, an important characteristic of this invention is that the two layers 28, 30 have different characteristics or hardnesses. Here, the outer layer 30 is a softer grade of elastomer than the inner layer 28 and the properties of the two layers are given in the following table:

TABLE 1

| | Inner Layer 28 | Outer Layer 30 |
|---|---|---|
| Hardness | 40–50 Shore 'D' | 70–85 Shore 'A' |
| 100% Tensile modulus | 11 Mpa | 5.5 Mpa |
| Flexural modulus | 63 Mpa | 28 Mpa |
| Shear modulus | 6–8 $MN/m^2$ | 4–5 $MN/m^2$ |

The inner layer 28 is harder and generally stiffer, and serves both to retain the lip dimension, i.e. the spacing across the bottom of the T-shaped slot 24, as indicated at 46.

The inner layer 28 also serves to protect the steel reinforcing elements 22 and the bond between these elements 22 and the TPU of the layer 28 as provided by a layer of adhesive. This is achieved by the layer 28 bearing loads imposed by drive rollers, as detailed below, with little deformation. This protects to elements 22 and their bond with the TPU from any excessive shear stresses. Fatigue tests of handrails formed from relatively soft material as compared to handrails formed from relatively hard material show that the hard material does indeed protection the tensile elements 22 in this way.

Figure 2B:
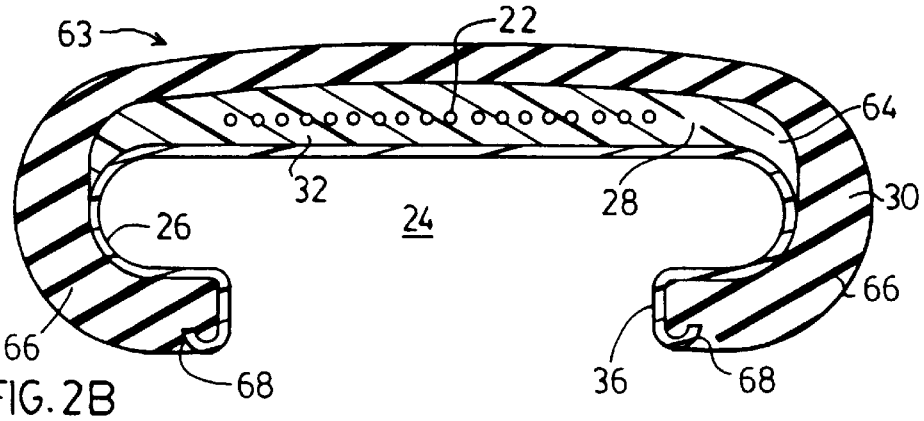
FIG. 2*b* is a cross-sectional view through a handrail in accordance with a second embodiment of the present invention.

Reference will now be made to FIG. 2*b* which shows a second embodiment of the handrail construction of the present invention. For simplicity, like components are given the same reference numeral as in FIG. 2*a*, and the description of the components is not repeated.

This second embodiment is designated in FIG. 2*b* by the reference 63, and as before has an inner layer 28, an outlet 30 and an appropriate stretch inhibiting member, again steel cables 22.

However, in this second embodiment, the inner layer 28 does not extend around the slider fabric 26, as in the first embodiment. Rather, the inner layer 28 has the upper portion 32, and shortened edge portions 64 which taper in thickness and terminate approximately halfway around the semi-circle around the ends of the slot 24.

Correspondingly, the outer layer 30 has approximately semi-circular end portions 66, which here taper in thickness, with increasing thickness towards the bottom thereof. This compensates for the tapering of the end or edge portions 64.

As before, the slider fabric 26 has vertical end surfaces 36. Here, the slider fabric 26 wraps around and has edges 68 embedded within the semi-circular portion 66.

A simple analysis would suggest that having a hard layer on the outside, for the outer layer 30, would only serve to stiffen the handrail and improve lip strength. However, analysis of drive tests have shown some important interactions between the drive and the handrail, which have resulted in the selection of a softer TPU for the outer layer 30.

Figure 5:
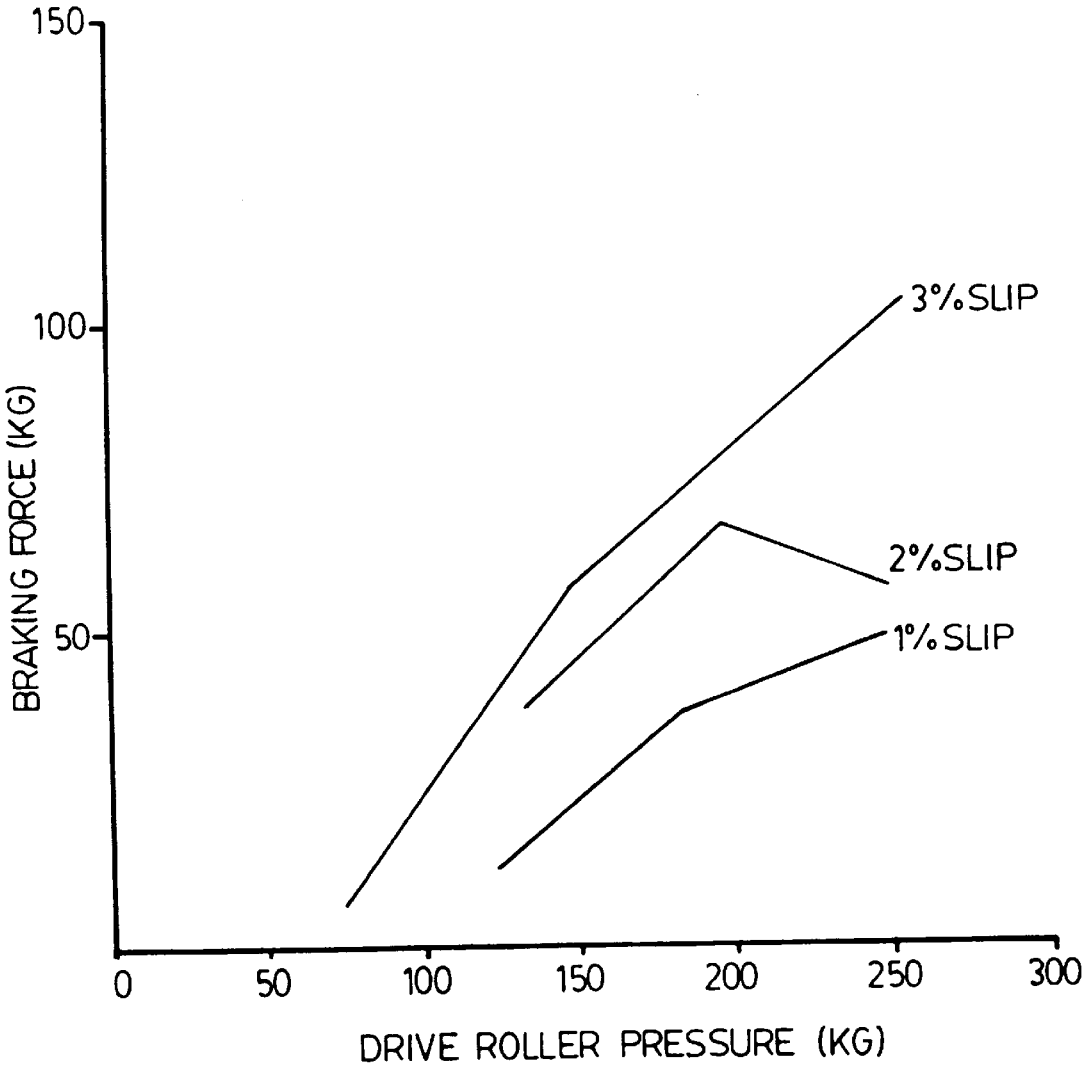
FIGS. 5, 6 and 7 are graphs showing variation of braking force with drive roller pressure for different slip rates, for three different handrail constructions.
Figure 6:
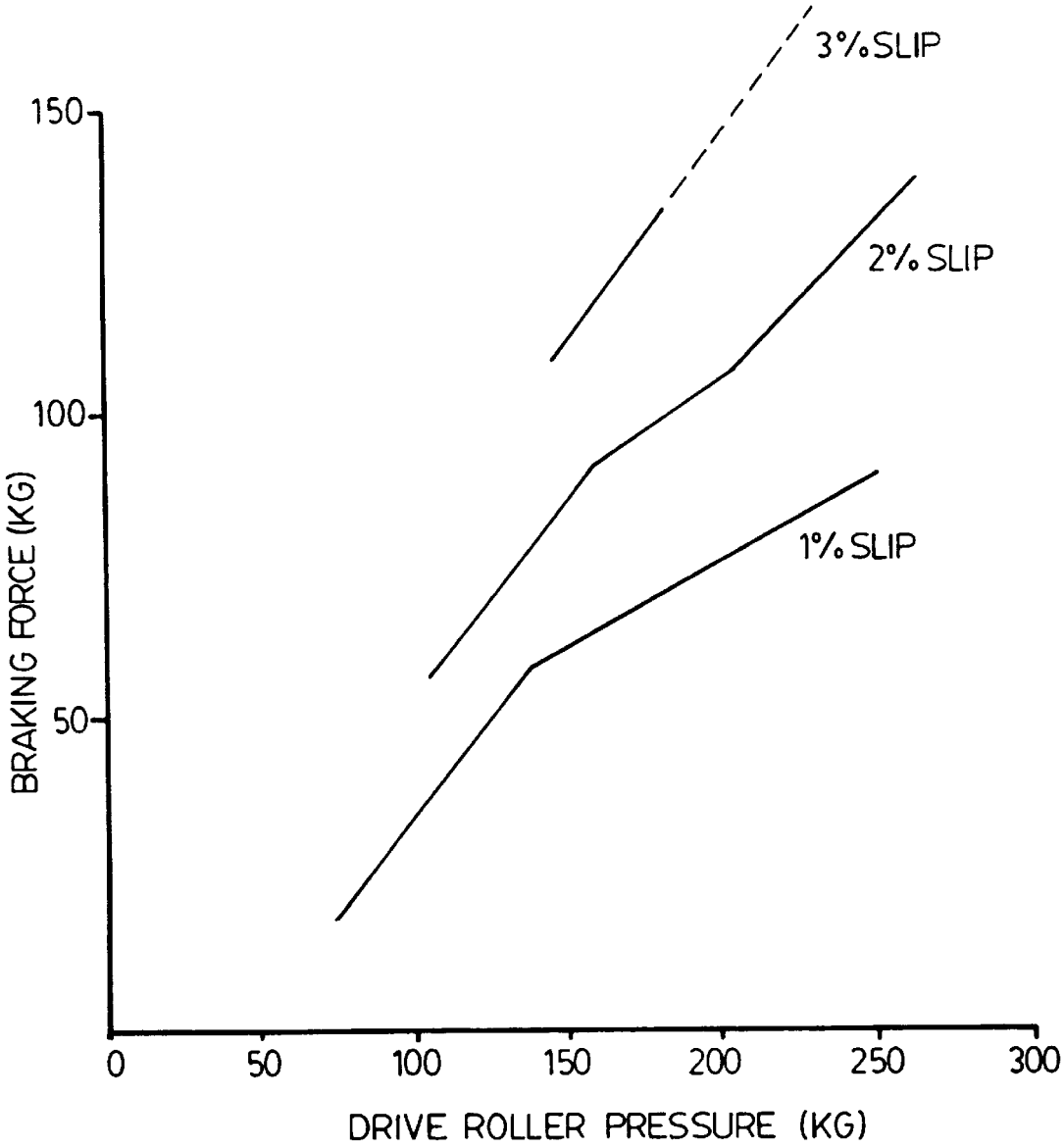
Figure 7:
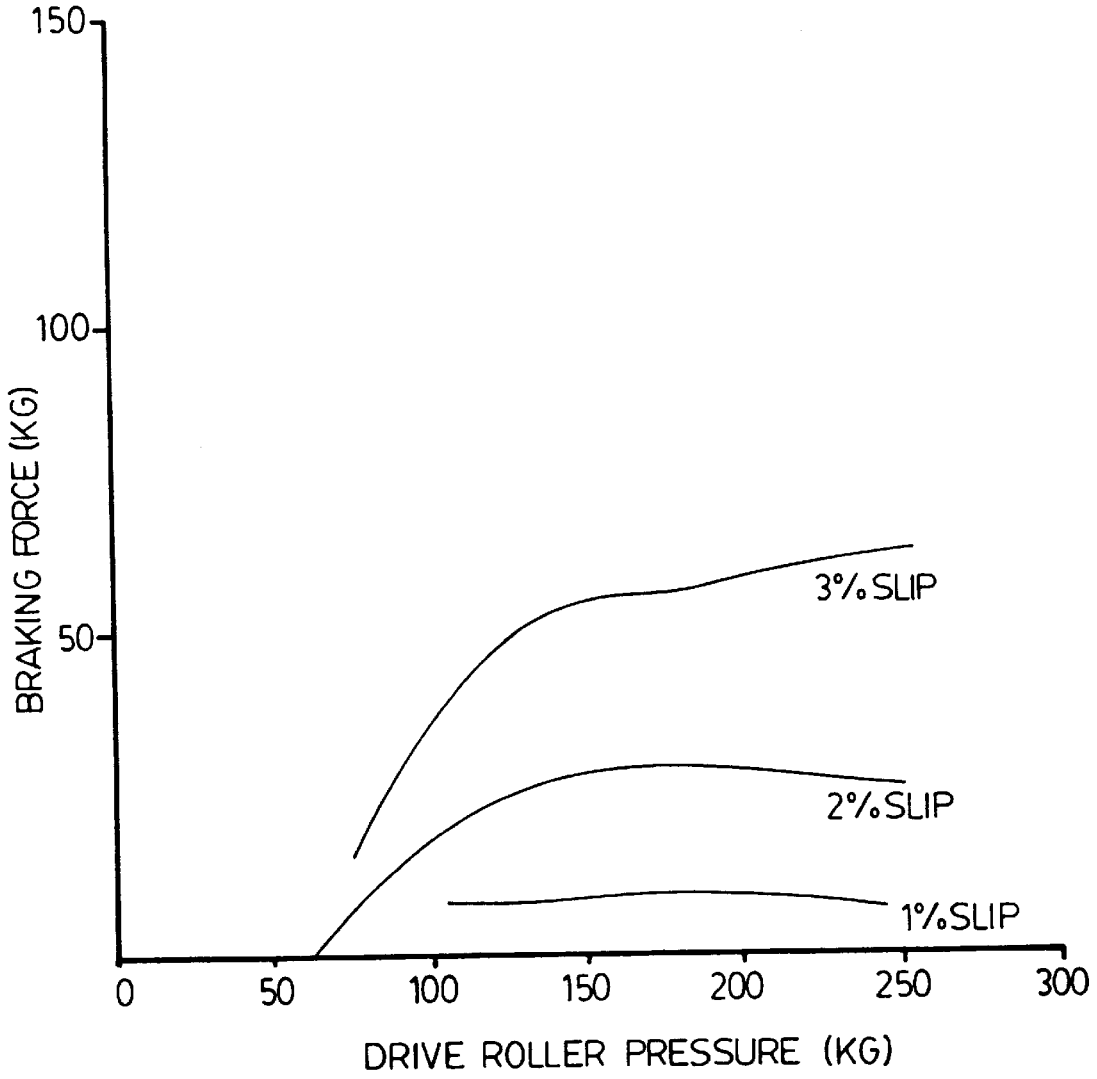

Referring now to FIGS. 5, 6 and 7, these show variations of drive characteristics for different handrail constructions. Thus, FIG. 5 shows variation of braking force with drive roller pressure for a handrail formed from a hard TPU having a Shore hardness of 45 Shore 'D' for both layers 28, 30. As for the other graphs, this shows three curves for different slip percentages of 1, 2 and 3%.

FIG. 6 shows a similar series of curves for a handrail formed with the inner layer 28 of a relatively hard TPU with the same Shore hardness of 45 Shore 'D' and the outer layer 30 of a relatively soft TPU with a hardness of 80 Shore 'A'. It can be seen that the drive characteristics are enhanced considerably. For any given slip percentage, a given drive roller pressure yields much a greater braking force indicative of the driving force that can be applied to the handrail.

By way of comparison, FIG. 7 shows drive curves for a conventional handrail formed from a thermoset material, with a sandwich ply construction as in U.S. Pat. No. 5,255,772 These show that above a drive roller pressure of approximately 130 kg, no significant increase in braking force is obtained for further increase in drive roller pressure. In general, the results are inferior to those of the extruded handrail of FIGS. 5 and 6, and clearly much inferior to those of FIG. 6, with the two different hardnesses of TPU. Such a handrail would have had two different hardnesses of material, albeit in a quite different configuration and with the harder layer being quite small. These results give no indication that any sort of improvement in drive characteristics can be obtained by the use of two different hardnesses of TPU.

Figure 8A:
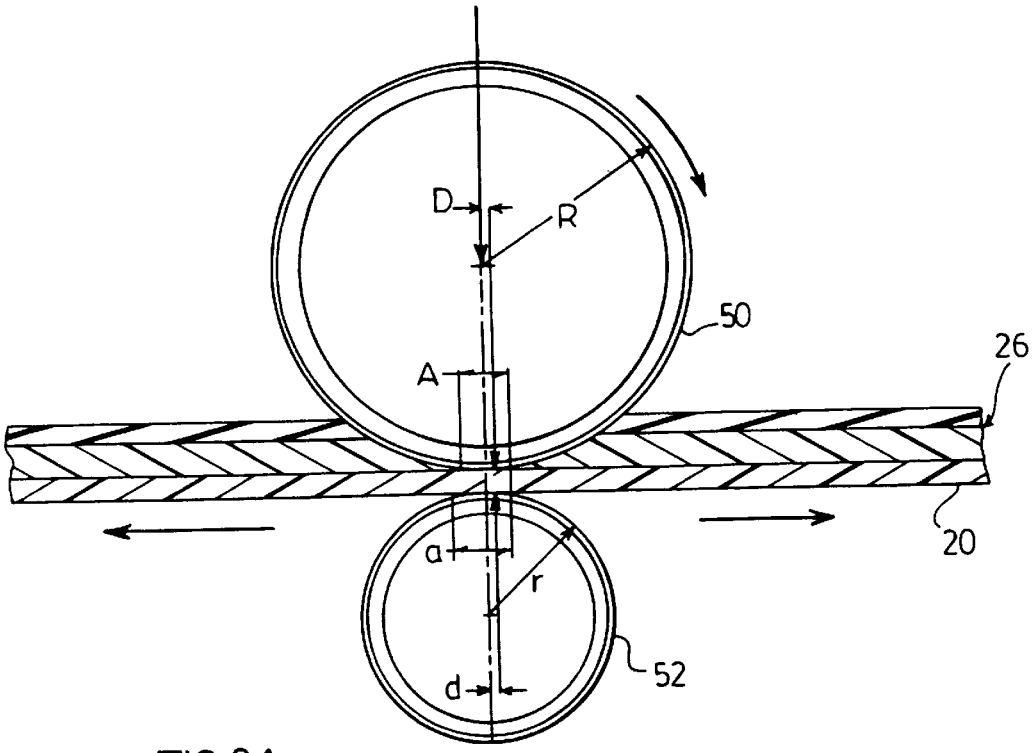
FIG. 8*a* is a schematic view of a linear drive apparatus and FIG. 8*b* is a view on an enlarged scale of the nip between the two rollers of FIG. 8*a*.
Figure 8B:
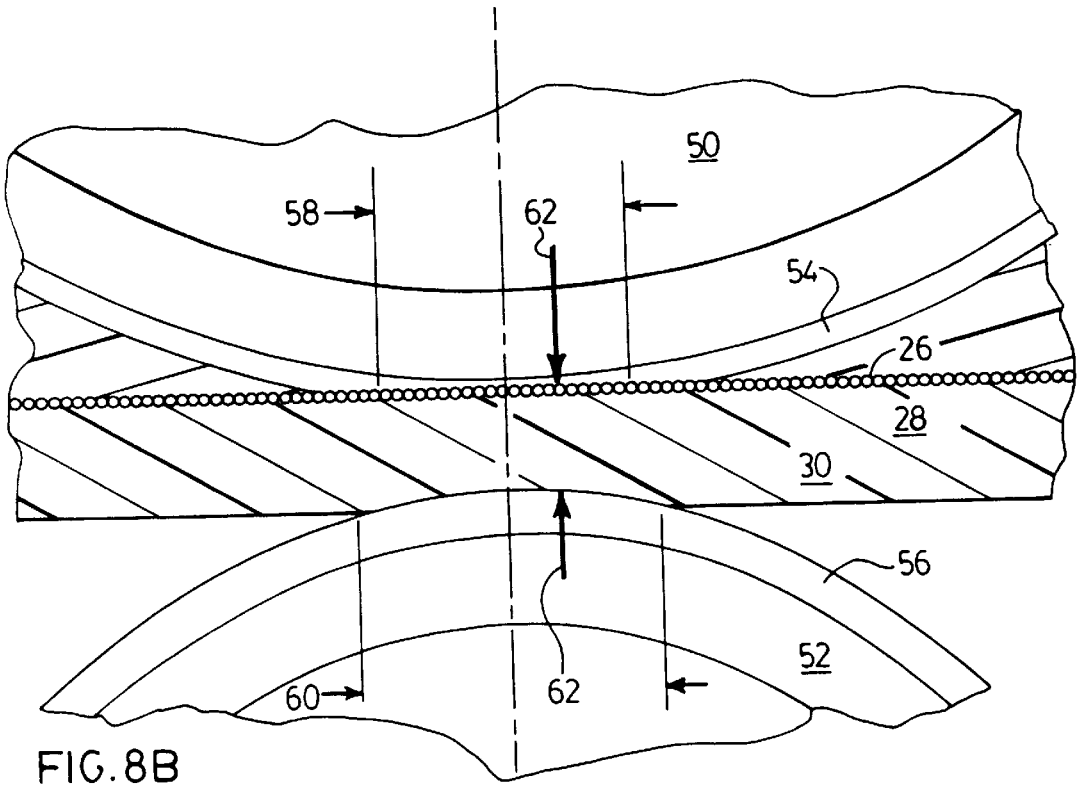

Reference will now be made to FIGS. 8*a*, 8*b* and 9, to explain a theory developed by the inventors to explain this behaviour. It is to be appreciated that this is a proposed theory, and should not be construed to limit the present invention in any way.

FIG. 8*a* shows a handrail 20 as it would be in the drive section, i.e. inverted. A drive roller 50 is pressed downward against the slider fabric 26, trapping the handrail 20 between the drive roller 50 and a follower roller 52.

The drive roller 50 is provided with a roller tread 54 (FIG. 8*b*), and correspondingly the follower roller 52 has a roller tread 56. The roller treads 54, 56 are formed from urethane or rubber with a suitable hardness, as described in greater detail below.

Figure 9A:
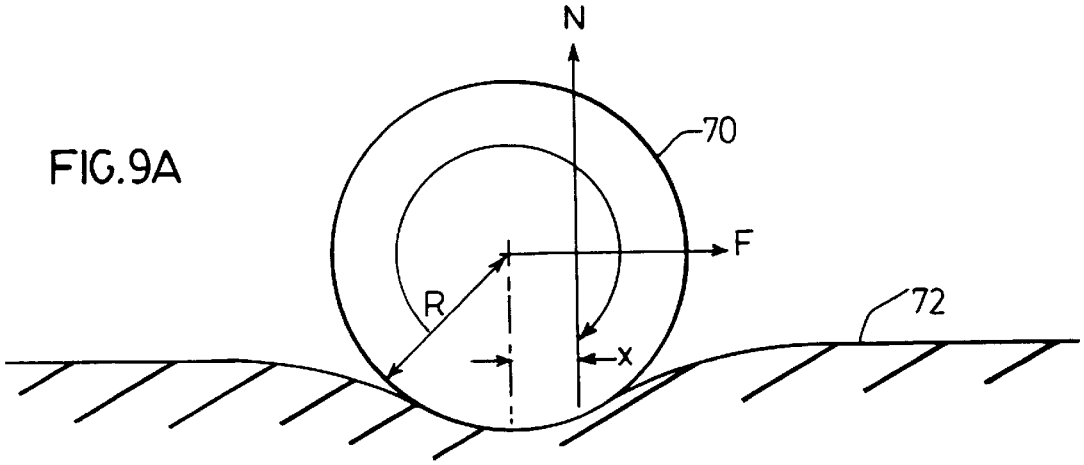
FIGS. 9*a*, 9*b* and 9*c* are schematic views showing a roller passing over a substrate and the behaviour of elastic and visco-elastic materials.

Now, it is known that when a roller rolls across the surface of a visco-elastic material substrate, a stress pattern is produced in the contact area, which increases the rolling resistance. This is shown in FIG. 9. FIG. 9*a* shows a roller 70 rolling across a substrate 72, to produce a contact area or footprint indicated at 74.

Figure 9B:
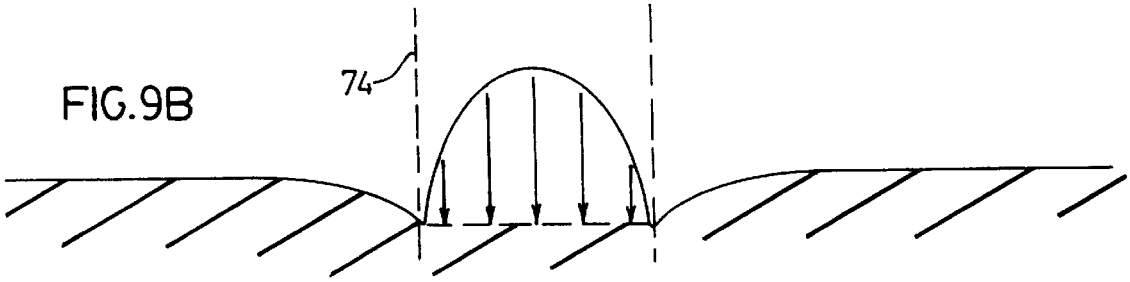

FIG. 9*b* shows the variation of contact stresses within the footprint or contact zone 74, for an elastic substrate, e.g. steel. As might be expected, these are generally symmetrical and do not cause any rolling resistance, and would be the same for movement of the roller in either direction.

Figure 9C:
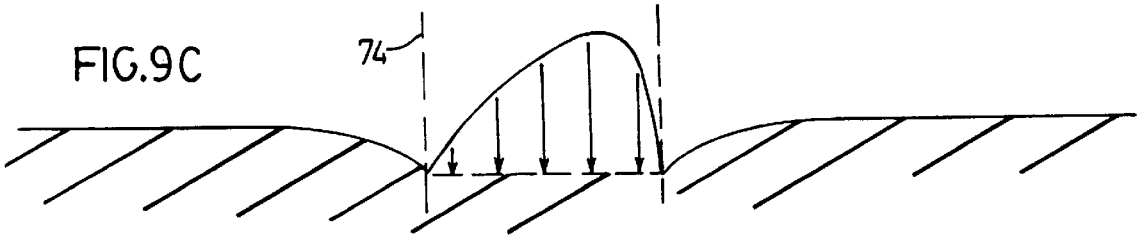

FIG. 9*c* shows the contact stresses for a visco-elastic substrate, moving in the direction indicated by the arrow F in FIG. 9*a*. Due to the viscous properties, there is an increase in stress towards the forward end of the footprint and a reduction at the rear.

This results in an upward force N balancing the load applied by the roller 70. This force N is offset forwardly be distance x from the axis of the roller 70. It will be appreciated that force F, indicated by an arrow, required to maintain the roller moving is then given by the equation:

$$FR=Nx$$

more particularly, one can define a coefficient of rolling friction by the following equation:

$$\mu_r = \frac{F}{N} = \frac{x}{R}$$

This coefficient can also be calculated from the following equation:

$$\mu_r = 0.25\left(\frac{N}{GR^2}\right)^{\frac{1}{3}} \tan\delta$$

Where G is the shear modulus, directly related to hardness, and tan δ is the mechanical loss tangent or factor. Thus, it is known that a visco-elastic material causes an offset of the centerline of a contact patch or the pressure distribution resulting from it. Now, what the present inventors have realized is that, as most commonly available linear drives have drive and follower rollers 50, 52 with different diameters, then their contact areas may not correspond. Thus, this could lead to two different offsets of their respective contact patches or footprints. For example, if the handrail was homogenous and if the two rollers had the same diameter, then necessarily one would expect similar offsets for the two contact patches. However, even for a homogenous handrail, due to the different diameters, there would be different offsets of their contact patches, resulting in inadequate support for the drive roller. In other words, if the drive roller's contact patch is offset by a large amount, then the handrail will deflect or otherwise move to balance this load, but the drive roller will not be properly supported.

Now, in accordance with the present invention, the outer or cover layer 30 is of a softer material. This results in the follower roller 52 generating a contact patch or footprint which is larger, or at least comparable with that for the drive roller 50. In FIG. 8*b,* this is shown in greater detail, and contact patches 58, 60 are shown for the two rollers 50, 52. The arrows 62 indicate the effective center of each contact patch, calculated from the pressure distribution, i.e. the point at which a point load equivalent to the pressure distribution would be applied. Thus, the larger footprint of the smaller roller 52 ensures that the drive roller 50 is now properly supported.

The second reason for improved drive is also shown in FIG. 9. Since the inner layer or main carcass 28 of the handrail is formed from the harder material, the slider fabric 26 tends to be pressed into the roller tread 54, rather than into the layer 28. This allows the roller 20 to obtain adequate traction by "biting" into the traction surface presented by the fabric 26.

It is to be noted that the wheel tread 54 should be reasonably hard, for example with a hardness in the range 90–94 Shore 'A', since this will ensure good wear characteristics. A soft tread 54 may give a larger footprint and conform better to the fabric texture, but it will likely suffer from an excessive wear rate due to scrubbing in the footprint area. Also, a relatively thin tread 54, which is not too soft is desirable, to prevent build up of heat due to hysteresis. A thin tread also ensures that the heat is conducted away to the roller 50.

It can further be noted that it is advantageous for the layer 28, unlike in U.S. Pat. No. 5,255,772, to be formed solely from an elastomeric substance, rather than some laminated structure. A homogenous layer 28 will be more resilient and give lower viscous energy losses, thereby offering less rolling resistance. This in turn helps to negate the effect of slippage. In contrast, a complex laminated structure can often increase energy losses, leading to increased rolling resistance, and in turn causing increased slippage.

A further advantage of a relatively hard layer 28 is to withstand the loads applied as the handrail passes through the nip between the rollers 50, 52. These loads have the effect of locally compressing the handrail, causing it to spread out laterally. The steel wires prevent any significant stretching in the axial direction, but the deformation of these wires laterally has the effect of axially shortening the handrail directly under the wheel 50. When the stress is removed the steel wires contract back into the regular, narrow array, and the handrail springs back to its original length. This temporary, pressure induced length change can actually cause the handrail to move slightly (about 1%) faster than the drive wheel 50, thereby making up for some possible slippage.

The handrail of the present invention, i.e. as in FIGS. 2*a* and 2*b*, has given another advantage. In testing on a test escalator balustrade, it has been found that power and drive force required were lower than with a conventional handrail as in FIG. 1. It is believed that this is because the hard layer 28 stiffens the handrail not only laterally, to improve lip strength, but also axially. In contrast the structure of FIG. 1, as in U.S. Pat. No. 5,255,772, provides plies that are distinctly orthotropic, in that they provide glass fiber strands extending transversely to stiffen the handrail transversely, but these have no effect in the axial direction, so that they don't increase the bending stiffness about the neutral axis. Consequently, this type of structure can be relatively flexible as it passes around drive rollers, newel end rollers etc. This, it is believed, causes the handrail to engage these rollers closely. In contrast, with the handrail of the present invention, the layer 28 gives it a certain stiffness, which would prevent the handrail from bending excessively and engaging newel end rollers and the like too closely; rather, there is likely more of a tangential contact between the handrail and the various rollers, which reduces friction, which in turn reduces the load or torque on the drive motor. The degree of this stiffening will depend on the grades of thermoplastics chosen and the configuration of the various layers. FIG. 2*a*, with the layer extending all around the slot, should be stiffer than the structure of FIG. 2*b*, with the layers extending just partially around the slot 24.

Figure 3:
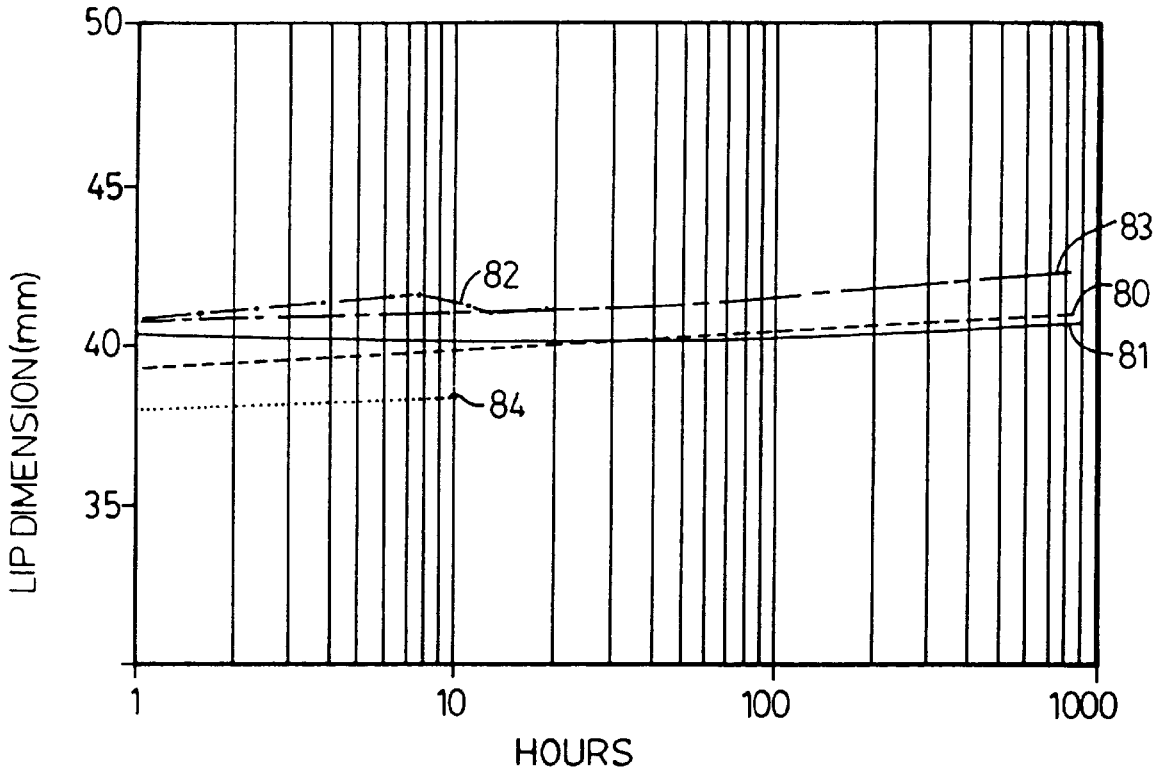
FIG. 3 is a graph showing variation of lip dimension against time on a test rig.
Figure 4:
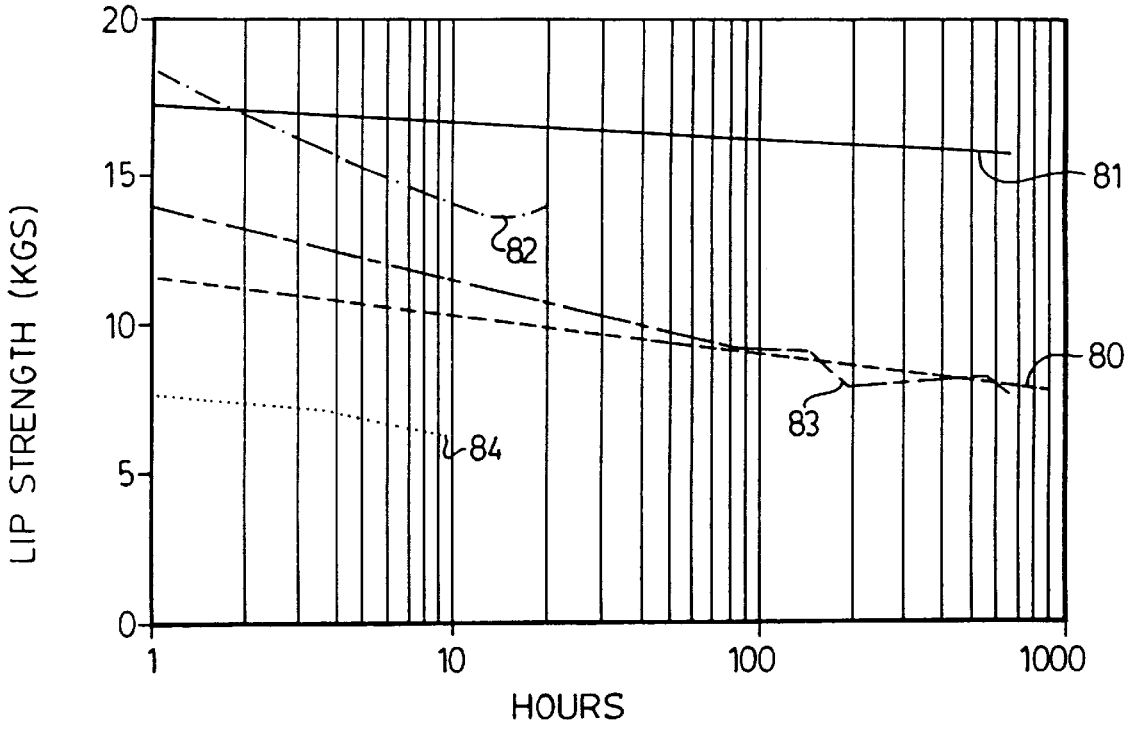
FIG. 4 is a graph showing variation of lip strength against time on a test rig.

Reference will now be made to FIGS. 3 and 4, which show comparisons of lip dimensions and lip strength against number of hours on a test rig for different handrails.

Referring first to FIG. 3, this shows at 80, an extruded handrail in accordance with the present invention of FIG. 2*a*, with a relatively soft layer 28 and a relatively soft cover 30. These show an adequate lip dimension but deteriorating slightly with time. For this test, a 5.6 meter handrail was tested at 60 m/min. on a three roller Hitachi linear drive unit with 230 kg force drive roller pressure and 120 kg force braking force. A test under similar conditions but with a layer 28 with a 45 Shore 'D' hardness and an outer layer 30 with an 85 Shore 'A' hardness is shown at 81. This shows much more consistent performance and less degradation with time.

At 82, there is shown a test of a handrail manufactured using cotton body plies as in U.S. Pat. No. 3,463,290. This was tested under similar load conditions and speeds for a 20 m length. For up to ten hours, which is a relatively short time, this shows adequate performance.

A conventional handrail manufactured by thermoset techniques according to U.S. Pat. No. 5,255,772 is shown at 83. This was a 10 m length, run at 60 m/min. on a Westinghouse type linear drive unit with 50 kg force drive roller pressure on four rollers and no braking force. This shows progressive degradation with time.

Finally, a further European handrail, identified at 84 and not specifically designed for linear drives was tested with the same loads and speeds as the test for 80, 81 and 82. This was for a 10 m length of handrail. For the short time tested, this shows adequate performance.

These tests shows that, with a hard layer 28 and a relatively soft layer 30, good performance can be obtained and held for up to a 1000 hrs.

Referring to FIG. 4, this shows variations of lip strength with time. For convenience, the same reference numerals are used as in FIG. 3, since they relate to identically the same test handrails.

Thus, it can be seen that the handrails of the present invention shown at 80, 81 show good performance, and indeed increasing lip strength with time. As might be expected, the line 81 shows that with a hard inner layer 28, one obtains an increased lip strength, which is maintained with time, as compared with having two soft layers 28, 30, as indicated at 80.

In general, results at 80, 81, and particularly the line 81 show that the handrail of the present invention gives improved performance. The cotton body ply handrail 82, as per U.S. Pat. No. 3,463,290 shows good initial lip strength but this degrades rapidly and after only 20 hrs has degraded significantly. The conventional handrail shown at 83 also shows significant degradation with time, and worse than that of the present invention.

We claim:

1. A moving handrail construction, the handrail having a generally C-shaped cross-section and defining an internal generally T-shaped slot, the handrail being formed by extrusion and comprising:

(1) a first layer of thermoplastic material extending around the T-shaped slot;

(2) a second layer of thermoplastic material extending around the outside of the first layer and defining the exterior profile of the handrail;

(3) a slider layer lining the T-shaped slot and bonded to the first layer at least; and (4) a stretch inhibitor extending within the first layer, wherein the first layer is formed from a harder thermoplastic than the second layer.

2. A handrail as claimed in claim 1, wherein the handrail comprises an upper web above the T-shaped slot and two lip portions extending downwardly from the upper web around the T-shaped slot, wherein, within the upper web at least, the first layer is thicker than the second layer.

3. A handrail as claimed in claim 2, wherein the first layer of thermoplastic comprises at least 60% of the thickness of the handrail in the upper web.

4. A handrail as claimed in claim 2, wherein the upper web has a thickness of approximately 10 mm and the first layer is at least 6 mm thick.

5. A handrail as claimed in claim 1, 2, 3 or 4, wherein the first layer has a hardness in the range 40–50 Shore 'D' and the second layer has a hardness in the range 70–85 Shore 'A'.

6. A handrail as claimed in claim 1, wherein the slider includes edge portions which extend out of the T-shaped slot and around the bottom of the first layer.

7. A handrail as claimed in claim 6, wherein the first layer includes generally semi-circular lip portions, which at their lower ends include vertical and opposed end surfaces and each of which includes a downwardly projecting rib adjacent the vertical end surface, wherein the edge portions of the slider layer extend around the ribs.

8. A handrail as claimed in claim 7, wherein the second layer includes generally semi-circular lip portions enclosing the semi-circular lip portions of the first layer and overlapping edge portions of the slider layer.

9. A handrail as claimed in claim 1, wherein the slider layer includes edge portions embedded within the second layer.

10. A handrail as claimed in claim 1, wherein the stretch inhibitor comprises a plurality of steel cables located in a common plane, generally centrally located within the first layer.

11. A handrail as claimed in claim 1, wherein each of the first and second layers has a generally uniform thickness.

12. A moving handrail construction, the handrail having a generally C-shaped cross-section and defining an internal, generally T-shaped slot, the handrail being formed by extrusion and comprising:

(1) a first layer of thermoplastic material extending around the T-shaped slot;

(2) a second layer of thermoplastic material extending around the outside of the first layer and defining the exterior profile of the handrail;

(3) a slider layer lining the T-shaped slot and bonded to first layer at least; and (4) a stretch inhibitor extending within the first layer, wherein the first layer is formed from a harder thermoplastic than the second layer, and wherein there is a direct interface between the first and second layers, with the first and second layers bonded to one another to form a continuous thermoplastic body, without any intervening layer of material between the first and second layers.

13. A handrail as claimed in claim 12, wherein the handrail comprises an upper web above the T-shaped slot and two lip portions extending downwardly from the upper web around the T-shaped slot, wherein, within the upper web at least, the first layer is thicker than the second layer.

14. A handrail as claimed in claim 13, wherein the first layer of thermoplastic comprises at least 60% of the thickness of the handrail in the upper web.

15. A handrail as claimed in claim 14, wherein the upper web has a thickness of approximately 10 millimeters and the first layer is at least 6 millimeters thick.

16. A handrail as claimed in claim 15, wherein the first layer has a hardness in the range 40–50 Shore 'D' and the second layer has a hardness in the range 70–85 Shore 'A'.

17. A moving handrail construction, the handrail having a generally C-shaped cross-section and defining an internal, generally T-shaped slot, the handrail being formed by extrusion and comprising:

(1) a first layer of thermoplastic material comprising an upper portion and tapered edge portions extending only partially around the T-shaped slot;

(2) a second layer of thermoplastic material comprising an upper portion abutting the first layer of thermoplastic material and semi-circular edge portions extending around the T-shaped slot, the second layer of thermoplastic material defining the exterior profile of the handrail;

(3) a slider layer lining the T-shaped slot and bonded to the first and second layers; and (4) a stretch inhibitor extending within the first layer, wherein the first layer is formed from a harder thermoplastic than the second layer.

* * * * *